US005545354A

United States Patent [19]

Ofosu-Asante

[11] Patent Number: 5,545,354

[45] **Date of Patent: * Aug. 13, 1996**

[54] LIQUID OR GEL DISHWASHING DETERGENT CONTAINING A POLYHYDROXY FATTY ACID AMIDE, CALCIUM IONS AND AN ALKYLPOLYETHOXYPOLYCARBOXYLATE

[75] Inventor: Kofi Ofosu-Asante, Cincinnati, Ohio

[73] Assignee: The Procter & Gamble Company, Cincinnati, Ohio

[ * ] Notice: The portion of the term of this patent subsequent to Oct. 31, 2014, has been disclaimed.

[21] Appl. No.: 938,978

[22] Filed: Sep. 1, 1992

[51] Int. Cl.[6] ..... C11D 1/08; C11D 1/52; C11D 3/04; C11D 17/08

[52] U.S. Cl. ..... 510/237; 510/476; 510/502; 510/423; 510/433; 510/434; 510/403; 510/427; 510/488

[58] Field of Search ..... 252/153, 173, 252/174.21, 174.19, 548, DIG. 14, 551, 547, 89.1, DIG. 11

[56] References Cited

U.S. PATENT DOCUMENTS

| | | | |
|---|---|---|---|
| 2,437,253 | 3/1948 | Henderson et al. | 252/109 |
| 2,703,798 | 3/1955 | Schwartz | 260/211 |
| 2,717,894 | 9/1955 | Schwartz | 260/211 |
| 2,965,576 | 12/1960 | Wilson | 252/137 |
| 3,200,136 | 8/1965 | Grossmith | 260/439 |
| 3,826,748 | 7/1974 | Finck | 252/99 |
| 3,963,649 | 6/1976 | Spadini | 252/546 |
| 4,133,779 | 1/1979 | Hellyer et al. | 252/547 |
| 4,166,048 | 8/1979 | Nishimura | 252/546 |
| 4,263,413 | 4/1981 | Gardner et al. | 525/34 |
| 4,316,824 | 2/1982 | Pancheri | 252/551 |
| 4,435,317 | 3/1984 | Gerritsen et al. | 252/547 |
| 4,486,338 | 12/1984 | Ootani | 252/545 |
| 4,492,646 | 1/1985 | Welch | 252/528 |
| 4,681,704 | 7/1987 | Bernardino et al. | 252/546 |
| 4,827,028 | 5/1989 | Scardera et al. | 562/583 |
| 4,904,359 | 2/1990 | Pancheri et al. | 252/548 |
| 5,009,814 | 4/1991 | Kelkenberg et al. | 252/548 |
| 5,030,245 | 7/1991 | Hemling et al. | 8/560 |
| 5,066,749 | 11/1991 | Leighton et al. | 526/271 |
| 5,073,293 | 12/1991 | Deguchi | 252/174.17 |
| 5,075,042 | 12/1991 | Allison et al. | 252/554 |

FOREIGN PATENT DOCUMENTS

| | | |
|---|---|---|
| WO90/00538 | 1/1990 | European Pat. Off. . |
| 92/06156 | 4/1992 | European Pat. Off. . |
| WO92/06171 | 4/1992 | European Pat. Off. . |
| WO92/08777 | 5/1992 | European Pat. Off. . |
| 1044301 | 4/1962 | United Kingdom . |

OTHER PUBLICATIONS

Copending U.S. Patent Appl. Ser. No. 07/819,559, Ofosu–Asante, filed Jan. 13, 1992.

Copending U.S. Patent Appl. Ser. No. 07,839,738, Cripe et al, filed Feb. 19, 1992.

Copending U.S. Patent Appl. Ser. No. 07/756,096, Fu, filed Sep. 6, 1991.

Copending U.S. Patent Appl. Ser. No. 07/755,905, Rolfes, filed Sep. 6, 1991.

Copending U.S. Patent Appl. Ser. No. 07/755,900, Ofosu–Asante, filed Sep. 6, 1991.

Copending U.S. Patent Appl. Ser. No. 07,938,979, Ofosu–Asante, filed Sep. 1, 1992.

Copending U.S. Patent Appl. Ser. No. 07,938,976, Ofosu–Asante, filed Sep. 1, 1992.

"Sequestered Polycarboxylated Surfactants", Tom S. Targos et al, 81st American Oil Chemists' Society Annual Meeting and Exposition, Baltimore, Maryland, May 22–25, 1990.

*Primary Examiner*—Dennis Albrecht
*Attorney, Agent, or Firm*—Thomas G. Krivulka; Mary P. McMahon

[57] ABSTRACT

Liquid or gel dishwashing detergent compositions containing anionic surfactant, polyhydroxy fatty acid amide, calcium ions and alkyl polyethoxypol ycarboxylate for improved stability are described. A preferred embodiment comprises:

(a) from about 3% to about 40% of polyhydroxy fatty acid amide having the formula:

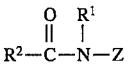

wherein $R^1$ is hydrogen, $C_{1-4}$ hydrocarbyl, 2-hydroxyethyl, 2-hydroxypropyl, or mixtures thereof; $R^2$ is $C_5$–$C_{31}$ hydrocarbyl; mid Z is a polyhydroxy-hydrocarbyl having a linear hydrocarbyl chain with at least three hydroxyl groups directly connected to the chain, or an alkoxylated derivative thereof;

(b) from about 0.1% to about 4% of calcium ions;

(c) from about 0.001% to about 15% of alkylpolyethoxypolycarboxylate surfactant having the general formula:

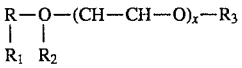

wherein R is a $C_6$ to $C_{18}$ alkyl group, x is from about 1 to about 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical, hydroxysuccinic acid radical, and $R_3$ is selected from the group consisting of hydrogen, substituted or unsubstituted hydrocarbon having between 1 and 8 carbon atoms, and mixtures thereof; and (d) from about 3 to about 95% of an anionic surfactant; wherein said composition has a pH in a 10% solution in water of between about 7 and about 9.

22 Claims, No Drawings

LIQUID OR GEL DISHWASHING DETERGENT CONTAINING A POLYHYDROXY FATTY ACID AMIDE, CALCIUM IONS AND AN ALKYLPOLYETHOXYPOLYCARBOXYLATE

TECHNICAL FIELD

The present invention relates to liquid or gel dishwashing detergent compositions containing polyhydroxy fatty acid amide, calcium ions, and alkylpolyethoxypolycarboxylate surfactant.

BACKGROUND OF THE INVENTION

Liquid or gel dishwashing detergents exhibiting good grease removal benefits are much desired by consumers. The addition of calcium or magnesium ions to liquid or gel dishwashing detergent can under certain conditions improve the grease cleaning benefits of the composition. However, it may be necessary to limit the pH and/or add chelating agents or lime soap dispersants to stabilize the product. As concentrated products become increasingly more popular, ingredients which can contribute a variety of benefits is very important in formulating a product.

It has been found that certain alkylpolyethoxypolycarboxylate surfactants when added to a liquid or gel dishwashing detergent composition containing calcium ions, anionic surfactant, and poly hydroxy fatty acid amide and having a pH of from about 7 to about 11, prevent insoluble salt precipitation and also act as a hydrotrope and a surfactant (if used in sufficient quantities).

SUMMARY OF THE INVENTION

A light-duty liquid or gel dishwashing detergent composition comprising, by weight:

(a) from about 3% to about 40% of polyhydroxy fatty acid amide having the formula:

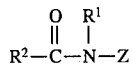

wherein $R^1$ is hydrogen, $C_{1-4}$ hydrocarbyl, 2-hydroxyethyl, 2-hydroxypropyl, or mixtures thereof; $R^2$ is $C_5$–$C_{31}$ hydrocarbyl; and Z is a polyhydroxy-hydrocarbyl having a linear hydrocarbyl chain with at least three hydroxyl groups directly connected to the chain, or an alkoxylated derivative thereof;

(b) from about 0.1% to about 4% of calcium ions;

(c) from about 0.001% to about 15% of alkylpolyethoxypolycarboxylate surfactant having the general formula:

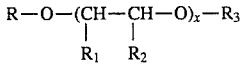

wherein R is a $C_6$ to $C_{18}$ alkyl group, x is from about 1 to about 25, $R_1$ and $R_2$ are selected from the group consisting of hydrogen, methyl acid radical, succinic acid radical, hydroxysuccinic acid radical, and mixtures thereof, wherein at least one $R_1$ or $R_2$ is a succinic acid radical, hydroxysuccinic acid radical, and $R_3$ is selected from the group consisting of hydrogen, substituted or unsubstituted hydrocarbon having between 1 and 8 carbon atoms, and mixtures thereof; and (d) from about 3 to about 95% of an anionic surfactant; wherein said composition has a pH in a 10% solution in water of between about 7 and about 9.

A particularly preferred embodiment also comprises from about 0.5% to about 10% of suds booster selected from the group consisting of alkylamidopropyl amine oxide, alkyl amine oxide, alkyldimethylbetaine, alkylamidopropylbetaine, alkylmonoethanol amide, and alkyldiethanol amide.

DETAILED DESCRIPTION OF THE INVENTION

The liquid or gel, preferably liquid, dishwashing detergent compositions of the present invention contain a polyhydroxy fatty acid amide, an anionic surfactant, a source of calcium ions and an alkylpolyethoxypolycarboxylate surfactant. The compositions herein may also contain suds booster. These and other complementary optional ingredients typically found in liquid or gel dishwashing compositions are set forth below.

The term "light duty dishwashing detergent compositions" as used herein refers to those compositions which are employed in manual (i.e. hand) dishwashing.

Polyhydroxy Fatty Acid Amide

The compositions of the present invention comprise from about 3% to about 40%, preferably from about 5% to about 30%, more preferably from about 8% to about 25%, by weight of the composition of one or more polyhydroxy fatty acid amides having the structural formula:

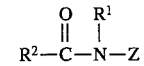

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight-chain $C_7$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2(CHOH)_n—CH_2OH$, $—CH(CH_2OH)—(CHOH)_{n-1}—CH_2OH$, $—CH_2(CHOH)_2(CHOH')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula

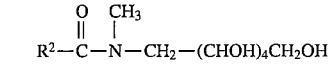

wherein $R^2$ is a straight chain $C_{11}$–$C_{17}$ alkyl or alkenyl group.

Method of Preparation

In general, polyhydroxy fatty acid amides can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In one process for producing N-alkyl or N-hydroxyalkyl, N-deoxyglycityl fatty acid amides wherein the glycityl component is derived from glucose and the N-alkyl or N-hydroxy- alkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of alkali metal alkoxide, trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl -glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglucosides, linear glucamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate.

The polyhydroxy "fatty acid" amide materials used herein also offer the advantages to the detergent formulator that they can be prepared wholly or primarily from natural, renewable, non-petrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product The level of these by-products will vary depending upon the particular reactants and process conditions, but are preferably kept to a minimum.

Alternate Method

An alternate method for preparing the polyhydroxy fatty acid amides used herein is as follows. A reaction mixture consisting of 84.87 g. fatty acid methyl ester (source: Procter & Gamble methyl ester CE1270), 75 g. N-methyl-D-glucamine (source: Aldrich Chemical Company M4700-0), 1.04 g. sodium methoxide (source: Aldrich Chemical Company 16,499-2), and 68.51 g. methyl alcohol is used. The reaction vessel comprises a standard reflux set-up fitted with a drying tube, condenser and stir bar. In this procedure, the N-methyl glucamine is combined with methanol with stirring under argon and heating is begun with good mixing (stir bar; reflux). After 15–20 minutes, when the solution has reached the desired temperature, the ester and sodium methoxide catalyst are added. Samples are taken periodically to monitor the course of the reaction, but it is noted that the solution is completely clear by 63.5 minutes. It is judged that the reaction is, in fact, nearly complete at that point. The reaction mixture is maintained at reflux for 4 hours. After removal of the methanol, the recovered crude product weighs 156.16 grams. After vacuum drying and purification, an overall yield of 106.92 grams purified product is recovered. However, percentage yields are not calculated on this basis, inasmuch as regular sampling throughout the course of the reaction makes an overall percentage yield value meaningless. The reaction can be carried out at 80% and 90% reactant concentrations for periods up to 6 hours to yield products with extremely small by-product formation.

The following is not intended to limit the invention herein, but is simply to further illustrate additional aspects of the technology which may be considered by the formulator in the manufacture of a wide variety of detergent compositions using the polyhydroxy fatty acid amides.

It will be readily appreciated that the polyhydroxy fatty acid amides are, by virtue of their amide bond, subject to some instability under highly basic or highly acidic conditions. While some decomposition can be tolerated, it is preferred that these materials not be subjected to pH's above about 11, preferably 10, nor below about 3 for unduly extended periods. Final product pH (liquids) is typically 6.0–9.0.

During the manufacture of the polyhydroxy fatty acid amides it will typically be necessary to at least partially neutralize the base catalyst used to form the amide bond. While any acid can be used for this purpose, the detergent formulator will recognize that it is a simple and convenient matter to use an acid which provides an anion that is otherwise useful and desirable in the finished detergent composition. For example, citric acid can be used for purposes of neutralization and the resulting citrate ion (ca. 1%) be allowed to remain with a ca. 40% polyhydroxy fatty acid amide slurry and be pumped into the later manufacturing stages of the overall detergent-manufacturing process. The acid forms of materials such as oxydisuccinate, nitrilotriacetate, ethylenediaminetetraacetate, tartrate/succinate, and the like, can be used similarly.

The polyhydroxy fatty acid amides derived from coconut alkyl fatty acids (predominantly $C_{12}$–$C_{14}$) are more soluble than their tallow alkyl (predominantly $C_{16}$–$C_{18}$) counterparts. Accordingly, the $C_{12}$–$C_{14}$ materials are somewhat easier to formulate in liquid compositions, and are more soluble in cool-water laundering baths. However, the $C_{16}$–$C_{18}$ materials are also quite useful, especially under circumstances where warm-to-hot wash water is used. Indeed, the $C_{16}$–$C_{18}$ materials may be better detersive surfactants than their $C_{12}$–$C_{14}$ counterparts. Accordingly, the formulator may wish to balance ease-of-manufacture vs. performance when selecting a particular polyhydroxy fatty acid amide for use in a given formulation.

It will also be appreciated that the solubility of the polyhydroxy fatty acid amides can be increased by having points of unsaturation and/or chain branching in the fatty acid moiety. Thus, materials such as the polyhydroxy fatty acid amides derived from oleic acid and iso-stearic acid are more soluble than their n-alkyl counterparts.

Likewise, the solubility of polyhydroxy fatty acid amides prepared from disaccharides, trisaccharides, etc., will ordinarily be greater than the solubility of their monosaccharide-derived counterpart materials. This higher solubility can be of particular assistance when formulating liquid compositions. Moreover, the polyhydroxy fatty acid amides wherein the polyhydroxy group is derived from maltose appear to function especially well as detergents when used in combination with conventional alkylbenzene sulfonate ("LAS") surfactants. While not intending to be limited by theory, it appears that the combination of LAS with the polyhydroxy fatty acid amides derived from the higher saccharides such as maltose causes a substantial and unexpected lowering of interfacial tension in aqueous media, thereby enhancing net detergency performance. (The manufacture of a polyhydroxy fatty acid amide derived from maltose is described hereinafter.)

The polyhydroxy fatty acid amides can be manufactured not only from the purified sugars, but also from hydrolyzed starches, e.g., corn starch, potato starch, or any other convenient plant-derived starch which contains the mono-, di-, etc. saccharide desired by the formulator. This is of particular importance from the economic standpoint. Thus, "high glucose" corn syrup, "high maltose" corn syrup, etc. can conveniently and economically be used. De-lignified, hydrolyzed cellulose pulp can also provide a raw material source for the polyhydroxy fatty acid amides.

As noted above, polyhydroxy fatty acid amides derived from the higher saccharides, such as maltose, lactose, etc., are more soluble than their glucose counterparts. Moreover, it appears that the more soluble polyhydroxy fatty acid amides can help solubilize their less soluble counterparts, to varying degrees. Accordingly, the formulator may elect to use a raw material comprising a high glucose corn syrup, for example, but to select a syrup which contains a modicum of maltose (e.g., 1% or more). The resulting mixture of polyhydroxy fatty acids will, in general, exhibit more preferred solubility properties over a broader range of temperatures and concentrations than would a "pure" glucose-derived polyhydroxy fatty acid amide. Thus, in addition to any economic advantages for using sugar mixtures rather than pure sugar reactants, the polyhydroxy fatty acid amides prepared from mixed sugars can offer very substantial advantages with respect to performance and/or ease-of-formulation. In some instances, however, some loss of grease removal performance (dishwashing) may be noted at fatty acid maltamide levels above about 25% and some loss in sudsing above about 33% (said percentages being the percentage of maltamide-derived polyhydroxy fatty acid amide vs. glucose-derived polyhydroxy fatty acid amide in the mixture). This can vary somewhat, depending on the chain length of the fatty acid moiety. Typically, then, the formulator electing to use such mixtures may find it advantageous to select polyhydroxy fatty acid amide mixtures which contain ratios of monosaccharides (e.g., glucose) to di- and higher saccharides (e.g., maltose) from about 4:1 to about 99:1.

The manufacture of preferred, uncyclized polyhydroxy fatty acid amides from fatty esters and N-alkyl polyols can be carried out in alcohol solvents at temperatures from about 30° C.–90° C., preferably about 50° C.–80° C. It has now been determined that it may be convenient for the formulator of, for example, liquid detergents to conduct such processes in 1,2-propylene glycol solvent, since the glycol solvent need not be completely removed from the reaction product prior to use in the finished detergent formulation. Likewise, the formulator of, for example, solid, typically granular, detergent compositions may find it convenient to run the process at 30° C.–90° C. in solvents which comprise ethoxylated alcohols, such as the ethoxylated (EO 3-8) $C_{12}$–$C_{14}$ alcohols, such as those available as NEODOL 23 EO6.5 (Shell). When such ethoxylates are used, it is preferred that they not contain substantial amounts of unethoxylated alcohol and, most preferably, not contain substantial amounts of mono-ethoxylated alcohol. ("T" designation.)

Fatty Acids

For compositions where especially high sudsing is desired (e.g., light-duty dishwashing), it is preferred that less than about 5%, preferably less than about 2%, most preferably no $C_{14}$ or higher fatty acids be present, since these can suppress sudsing. Liquid detergent compositions herein are preferably substantially free of a suds-suppressing amount of $C_{14}$ and higher fatty acid. Accordingly, the formulator of high sudsing compositions will desirably avoid the introduction of suds-suppressing amounts of such fatty acids into high sudsing compositions with the polyhydroxy fatty acid amide, and/or avoid the formation of $C_{14}$ and higher fatty acids on storage of the finished compositions. One simple means is to use $C_{12}$ ester reactants to prepare the polyhydroxy fatty acid amides herein. Fortunately, the use of alkylpolyethoxypolycarboxylate, amine oxide or sulfobetaine surfactants can overcome some of the negative sudsing effects caused by the fatty acids. Most preferably, fatty acids should be avoided (less than about 2.5% by weight is preferred).

Calcium Ions

From about 0.1% to about 4%, more preferably from about 0.2% to about 2%, most preferably from about 0.3% to about 1.5% by weight of the composition, of calcium ions are included in the detergent compositions herein. It has been found for compositions containing the present polyhydroxy fatty acid amide that the presence of calcium greatly improves the cleaning of greasy soils. This is especially true when the compositions are used in softened water, which contains few divalent ions.

Furthermore, it has been found that formulating such calcium ion-containing compositions in alkaline pH matrices is difficult due to the incompatability of the calcium ions with hydroxide ions. When both calcium ions and alkaline pH are combined with the surfactant mixture of this invention, grease cleaning is achieved that is superior to that obtained by either alkaline pH or calcium ions alone. Yet, during storage, the stability of these compositions becomes poor due to the formation of hydroxide precipitates.

Preferably, the calcium ions are added as a chloride, hydroxide, oxide, acetate, formate, or nitrate salt, most preferably formate salt, to compositions containing an alkali metal or ammonium salt of the anionic sulfate, most preferably the ammonium salt (see methods of incorporation in Section E below). The calcium salts are preferably soluble.

The amount of calcium ions present in compositions of the invention may be dependent upon the amount of total anionic surfactant present therein. The molar ratio of calcium ions to total anionic surfactant is preferably from about 0.25:1 to about 1:2 for compositions of the invention.

Composition pH

Traditionally, liquid dishwashing compositions have a pH of about 7. Dishwashing compositions of the invention will be subjected to acidic stresses created by food soils when put to use, i.e., diluted and applied to soiled dishes. If a composition with a pH greater than 7 is to be most effective in improving performance, it should contain a buffering agent capable of maintaining the alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa value of the buffering agent should be between about 7 and about 8.5. Under these conditions the buffering agent most effectively controls the pH while using the least amount thereof. Preferably the composition of the present invention has a pH in a 10% solution of water at 20° C. between about 7 and about 11, more preferably from about 7.5 to about 10, most preferably from about 7.5 to about 8.5.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and tri-ethanolamine. Other preferred nitrogen-containing buffering agents are 2-amino-2-ethyl-1,3-propanediol, 2-amino-2-methylpropanol, and 2-amino-2-methyl-1,3-propanediol, tris-(hydroxymethyl)aminomethane (a.k.a. tris). N-methyl diethanolamine, 1,3-diamino-2-propanol N,N'-tetramethyl- 1,3-diamino-2-propanol, N,N-bis(2-hydroxyethyl)glycine (a.k.a. bicine), and N-tris(hydroxymethyl)methyl glycine (a.k.a. tricine) are also preferred. Mixtures of any of the above are acceptable.

The buffering agent is present in the compositions of the invention hereof at a level of from about 0.1% to 15%, preferably from about 1% to 10%, most preferably from about 2% to 8%, by weight of the composition.

Alkylpolyethoxypolycarboxylate Surfactant

The compositions of this invention contain alkylpolyethoxypolycarboxlyate surfactants of the general formula $$R-O-(\underset{\underset{R_1}{|}}{CH}-\underset{\underset{R_2}{|}}{CH}-O)_x-R_3$$

wherein R is a $C_6$ to $C_{18}$ alkyl group, x ranges from about 1 to about 24, $R_1$ and $R_2$ are selected from the group consisting of hydrogen, methyl radical or succinic acid radical, and mixtures thereof, wherein at least one $R_1$ or $R_2$ is a succinic acid and/or hydroxysuccinic acid radical. An example of a commercially available alkylpolyethoxpolycarboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent the cleaning benefits of the calcium ions. A high degree of ethoxylation is desired for mildness and solubility; however, too high a level will affect sudsing. Therefore, an alkylpolyethoxypolycarboxylate with a modest degree of ethoxylation and minimal carboxylation is preferable. Preferably the alkylpolyethoxypolycarboxylate surfactant comprises from about 1 to about 4, more preferably from about 1 to about 2, of succinic head groups and/or hydroxysuccinic acid (from about 2 to about 8 carboxyl groups, from about 2 to about 4 carboxyl groups, respectively), and from about 4 to about 12, more preferably from about 7 to about 11, ethoxy groups.

Alkylpolyethoxypolycarboxylate surfactants can be classified based upon the % hydrophilicity. This is calculated using the following formula:

$$\frac{\text{molecular wt. of ethoxy groups + molecular wt. of carboxyl groups}}{\text{molecular wt. of molecule}}$$

Preferably the alkylpolyethoxypolycarboxylate surfactant comprises from about 60% to about 90%, more preferably from about 65% to about 85%, most preferably from about 70% to about 85% hydrophilicity.

The desired alkylpolyethoxylpolycarboxylate surfactant can be obtained by a free radical addition reaction wherein the addition products of maleic acid, fumaric acid, itaconic acid or mixtures thereof, with a select poly(alkoxylated)alcohol produce a surfactant with excellent chelating properties. A process for producing such alkylpolyethoxypolycarboxylate surfactants is disclosed in U.S. Pat. Nos. 5,030,245 and 5,120,326, both of which are incorporated herein by reference.

Without being bound to theory it is believed that the carboxyl groups in the molecule preferentially bind the calcium ions in the composition resulting in the formation of calcium salts of alkylpolyethoxycarboxylates. The ethoxy groups in the molecule help in solubilizing the resultant salts, thus, a clear, stable composition is formed. In the absence of alkylpolyethoxypolycarboxylates, precipitates such as calcium fatty acids (from free, unreacted fatty acids of the polyhydroxy fatty acid amide), are formed, particularly at low temperatures. As the level of free fatty acids decreases so does the level of alkylployethoxypolycarboxylates needed to obtain clear stable composition; therefore, the benefits associated with the alkylpoly ethoxypolycarboxylate are most clearly evident in compositions containing fatty acids (i.e. unreacted fatty acids of the polyhydroxy fatty acid amide).

The compositions of the invention comprise from about 0.01% to about 15%, more preferably from about 0.1% to about 10%, most preferably from about 1% to about 5%, by weight of the composition, of alkylpolyethoxypolycarboyxlate surfactant.

Anionic Surfactant

The detergent compositions of the present invention comprise from about 3% to about 95%, more preferably from about 5% to about 60%, most preferably from about 10% to about 40%, by weight of the composition of one or more anionic surfactants.

The most preferred anionic surfactants are anionic sulfate surfactants which may be any organic sulfate surfactant. It is preferably selected from the group consisting of $C_{10}$–$C_{16}$ alkyl sulfate which has been ethoxylated with from about 0.5 to about 20 moles of ethylene oxide per molecule, $C_9$–$C_{17}$ acyl-N-($C_1$–$C_4$ alkyl) glucamine sulfate, -N-($C_2$–$C_4$ hydroxyalkyl) glucamine sulfate, and mixtures thereof. More preferably, the anionic sulfate surfactant is a $C_{10}$–$C_{16}$ alkyl sulfate which has been ethoxylated with from about 0.5 to about 20, preferably from about 0.5 to about 12, moles of ethylene oxide per molecule.

Alkyl ethoxy sulfate surfactants comprise a primary alkyl ethoxy sulfate derived from the condensation product of a $C_{10}$–$C_{16}$ alcohol with an average of from about 0.5 to about 20, preferably from about 0.5 to about 12, ethylene oxide groups. The $C_{10}$–$C_{16}$ alcohol itself is commercially available. $C_{12}$–$C_{14}$ alkyl sulfate which has been ethoxylated with from about 3 to about 10 moles of ethylene oxide per molecule is preferred.

Conventional base-catalyzed ethoxylation processes to produce an average degree of ethoxylation of 12 result in a distribution of individual ethoxylates ranging from 1 to 15 ethoxy groups per mole of alcohol, so that the desired average can be obtained in a variety of ways. B1 ends can be made of material having different degrees of ethoxylation and/or different ethoxylate distributions arising from the specific ethoxylation techniques employed and subsequent processing steps such as distillation.

Anionic sulfate surfactants include the $C_9$–$C_{17}$ acyl-N-($C_1$–$C_4$ alkyl) and -N-($C_1$–$C_2$ hydroxyalkyl) glucamine sulfates, preferably those in which the $C_9$–$C_{17}$ acyl group is derived from coconut or palm kernel oil. Lime soap dispersing agent can be added, especially to the longer chain length glucamine sulfates for improved product stability (e.g., where $C_9$–$C_{17}$ acyl is palm kernel oil). These materials can be prepared by the method disclosed in U.S. Pat. No. 2,717,894, Schwartz, issued Sep. 13, 1955, incorporated herein by reference.

The counterion for the anionic surfactant component is preferably selected from calcium, sodium, potassium, magnesium, ammonium or alkanol-ammonium, and mixtures thereof, with calcium and magnesium being preferred for cleaning and sudsing, respectively.

Other anionic surfactants useful for detersive purposes can also be included in the compositions hereof. Exemplary, non-limiting useful anionics include salts (e.g., sodium, potassium, ammonium, and substituted ammonium salts such as mono-, di- and triethanolamine salts) of soap, $C_8$–$C_{22}$ alkylsulfates, $C_8$–$C_{24}$ alkylpolyethersulfates (containing up to 10 moles of ethylene oxide); fatty acyl glycerol sulfates, alkyl phenol ethylene oxide ether sulfates, alkyl phosphates, isethionates such as the acyl isethionates, acyl taurates, fatty acid amides, alkyl succinates and sulfosuccinates, acyl sarcosinates, sulfates of alkylpolysaccharides such as the sulfates of alkylpolyglucoside, alkyl ether carbonates, alkyl ethoxy carboxylates, fatty acids esterified with isethionic acid and neutralized with sodium hydroxide, and fatty acids amides of methyl tauride. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Additional Optional Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from about 10 to about 20 carbon atoms with from about 2 to about 10 moles of ethylene oxide per mole of alcohol.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility.

4. The condensation products of ethylene oxide with the product resulting from the reaction of propylene oxide and ethylenediamine.

5. Semi-polar nonionic surfactants are a special category of nonionic surfactants which include water-soluble amine oxides containing one alkyl moiety of from 10 to 18 carbon atoms and 2 moieties selected from the group consisting of alkyl groups and hydroxyalkyl groups containing from 1 to 3 carbon atoms; water-soluble phosphine oxides containing one alkyl moiety of from 10 to 18 carbon atoms and 2 moieties selected from the group consisting of alkyl groups and hydroxyalkyl groups containing from 1 to 3 carbon atoms; and water-soluble sulfoxides containing one alkyl moiety of from 10 to 18 carbon atoms and a moiety selected from the group consisting of alkyl and hydroxyalkyl moieties of from 1 to 3 carbon atoms. Semi-polar nonionic detergent surfactants include the amine oxide surfactants 6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units.

7. Fatty acid amide surfactants having the formula:

$$R^6-\overset{\overset{\displaystyle O}{\|}}{C}-N(R^7)_2$$

wherein $R^6$ is an alkyl group containing from 7 to 21, preferably from 9 to 17, carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Ampholytic surfactants may also be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight-branched chains. One of the aliphatic substituents contains at least 8 carbon atoms, typically from 8 to 18 carbon atoms, and at least one contains an anionic water-solubilizing group, e.g., carboxy, sulfonate, sulfate. See U.S. Pat. No. 3,929,678 to Laughlin et al., issued Dec. 30, 1975, at column 19, lines 18–35 (herein incorporated by reference) for examples of useful ampholytic surfactants.

Zwitterionic surfactants may also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975, at column 19, line 38 through column 22, line 48 (herein incorporated by reference) for examples of useful zwitterionic surfactants.

Such ampholytic and zwitterionic surfactants are generally used in combination with one or more anionic and/or nonionic surfactants.

If included in the compositions of the present invention, these optional additional surfactants or mixtures thereof are typically present at a concentration of from about 1% to about 15%, preferably from about 2% to about 10% by weight of the composition.

Suds Booster

Another component which may be included in the composition of this invention is a suds stabilizing surfactant (suds booster) at a level of less than about 15%, preferably from about 0.5% to 12%, more preferably from about 1% to 10% by weight of the composition. Optional suds stabilizing surfactants operable in the instant composition are of five basic types—betaines, ethylene oxide condensates, fatty acid amides, amine oxide semi-polar nonionics, and cationic surfactants.

The composition of this invention can contain betaine detergent surfactants having the general formula:

$$R-\overset{(+)}{N}(R^1)_2-R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1-CO-N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula $$R_1(C_2H_4O)_n\overset{R_2}{\underset{R_3}{N^+}}\cdots O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

$$R_1-\overset{R_2}{\underset{R_3}{N^+}}\cdots O^-$$

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The composition of this invention can also contain certain cationic quarternary ammonium surfactants of the formula:

$$[R^1(OR^2)_y][R^3(OR^2)_{y12}R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethyl ammonium salts, $C_{8-16}$ alkyl di(hydroxyethyl)methylammonium salts, the $C_{8-16}$ alkyl hydroxyethyldimethyl ammonium salts, $C_{8-16}$ alkyloxypropyl trimethyl ammonium salts, and the $C_{8-16}$ alkyl oxypropyl dihydroxyethylmethylammonium salts. Of the above, the $C_{10-14}$ alkyl trimethylammonium salts are preferred, e.g., decyl trimethyl ammonium methyl sulfate, lauryl trimethyl ammonium chloride, myristyl trimethylammonium bromide and coconut trimethylammonium chloride, and methylsulfate.

The suds boosters used in the compositions of this invention can contain any one or mixture of the suds boosters listed above.

Magnesium

From about 0.05% to about 1.5%, most preferably from about 0.3% to about 0.9%, by weight of the composition, of magnesium ions may preferably be added to the liquid detergent compositions of the invention for improved product stability, as well as improved sudsing and skin mildness.

The preferred calcium ion:magnesium ion ratio is between about 1:10 and about 1:2, preferably between about 1:4 and about 1:2. It is preferred that the calcium ions are introduced by adding calcium chloride dihydrate or calcium formate to the composition and that the magnesium ions are introduced by adding magnesium chloride hexahydrate to the composition. From about 1% to about 5% by weight of calcium chloride dihydrate or calcium formate, and optionally from about 3% to about 7% of magnesium chloride hexahydrate, are preferred for a light duty liquid composition herein.

If the anionic surfactants are in the acid form, then the magnesium can be added by a second method: neutralization of the acid with a magnesium oxide or magnesium hydroxide slurry in water. Calcium can be treated similarly. The use of calcium hydroxide is preferred. This technique avoids the addition of chloride ions, which improves chill point and reduces corrosive properties. The neutralized surfactant salts and the hydrotrope are then added to the final mixing tank and any optional ingredients are added before adjusting the pH.

Other Optional Components

Other desirable ingredients include diluents, solvents, dyes, perfumes, opacifiers, and hydrotropes. Diluents can be inorganic salts, such as sodium and potassium sulfate, ammonium chloride, sodium and potassium chloride, sodium bicarbonate, etc. Diluents useful in the compositions of the present invention are typically present at levels of from about 1% to about 10%, preferably from about 2% to about 5% by weight of the composition.

Solvents useful herein include water and lower molecular weight alcohols, such as ethyl alcohol, isopropyl alcohol, etc. Solvents useful in the compositions of the present invention are typically present at levels of from about 1% to about 60%, preferably from about 5% to about 50% by weight of the composition.

Hydrotropes such as sodium, potassium, and ammonium xylene sulfonate (preferred), sodium, potassium and ammonium toluene sulfonate, sodium, potassium and ammonium cumene sulfonate (most preferred), and mixtures thereof, and related compounds (as disclosed in U.S. Pat. No. 3,915,903, the disclosure of which is incorporated herein) may be utilized in addition to the alylpolyethoxypolycarboxylate surfactants in the interests of achieving a desired product phase stability and viscosity. Hydrotropes useful in the compositions of the present invention are typically present at levels of from about 1% to about 10%, preferably from about 2% to about 5%, by weight of the composition.

Optional ingredients useful when the compositions of the present invention are used in liquid dishwashing detergent applications include drainage promoting ethoxylated nonionic surfactants of the type disclosed in U.S. Pat. No. 4,316,824, issued Pancheri, issued Feb. 23, 1982, the disclosure of which is incorporated herein by reference.

Opacifiers such as Lytron (Morton Thiokol, Inc.), a modified polystyrene latex, or ethylene glycol distearate can be added, preferably as a last step. Lytron can be added directly as a dispersion with mixing. Ethylene glycol distearate can be added in a molten state with rapid mixing to form pearlescent crystals. Opacifiers useful herein, particularly for light duty liquids, are typically present at levels of from about 0.2% to about 10%, preferably from about 0.5% to about 6% by weight of the composition.

In a preferred embodiment, the detergent compositions of the present invention are liquid detergent compositions. These preferred liquid detergent compositions comprise from about 94% to about 35% by weight, preferably from about 90% to about 50% by weight, most preferably from about 80% to about 60% by weight of a liquid carrier, e.g., water, preferably a mixture of water and a $C_1$–$C_4$ monohydric alcohol (e.g., ethanol, propanol, isopropanol, butanol, and mixtures thereof), with ethanol being the preferred alcohol. A preferred way to make light duty liquids of the present invention is to combine the polyhydroxy fatty acid amide and the alkyl (ethoxy) sulfate with water and ethanol. pH is adjusted and then calcium and optionally magnesium ions are mixed into the composition as aqueous solutions of chlorine salts. The mixture is blended and hydrotrope may be added to adjust the viscosity. Perfume, dye, opacifier, and other optional ingredients may then be added.

The detergent compositions of the present invention may also be in the form of a gel. Such compositions are typically formulated without alcohol and contain levels from about 10% to about 30% of urea and/or conventional thickeners.

The claimed compositions of the present invention are beneficial in that they provide unexpectedly a stable composition with improved grease cleaning performance and clean dishes without imparting a "greasy" feel to the cleaned dish.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

EXAMPLES

The following examples illustrate the compositions of the present invention, but are not necessarily meant to limit or otherwise define the scope of the invention. All parts, percentages and ratios used herein are by weight unless otherwise specified.

Example I

The following light duty liquid compositions of the present invention are prepared according to the descriptions set forth below.

A surfactant paste is initially formed by combining any desired surfactants with water and alcohol. The surfactants in this surfactant paste include the polyhydroxy fatty acid amides of the present invention. Ideally the surfactant paste should be pumpable at room or elevate temperatures. Separately, in a large mixing vessel having a propeller mixer, three-quarters of the water of the formulated product, one-half of the alcohol of the formulated product, one-half of the alcohol of the formulated product, and any optional hydrotropes (e.g. xylene, cumene, toluene sulfonates) and alkylpolyethoxypolycarboxylate surfactant (i.e. Polytergent C) are combined with mixing to give a clear solution. The surfactant paste is added and the pH of the mixture is adjusted to 7.0–7.5, before the calcium ions are added.

The calcium ions may be added directly to the mixing vessel as calcium chloride, calcium formate, or as calcium oxide or hydroxide powder. The calcium oxide or hydroxide powder is added to the acid form of the surfactant salts (e.g. alkyl benzene sulfonates, alkyl sulfates, alkyl ethoxylated sulfates, methyl ester sulfonates, etc.) in the surfactant paste. When calcium is added as a oxide or hydroxide powder, a less than stoichimometrically required amount is added with mixing to ensure complete dissolution. The pH of the calcium-containing surfactant paste is then adjusted by using NaOH or KOH solutions.

The mixture is mixed until a homogenous, clear solution product is obtained. Additional water, alcohol, and any desired additional hydrotropes (added as a solution) may then be added to trim the solution product viscosity to the desired level, ideally between 50 and 1000 cps, as measured by a Brookfiled viscometer at 70° F. The pH of the final product is then adjusted with either HCl or NaOH to a level of 7.0±0.7 for formulas containing ammonium ions, and 8.5±1.5 for formulas which do not contain ammonium ions.

Perfume, dye and other ingredients, e.g., opacifying agents such as Lytron and ethylene glycol distearate, are added as the last step. Lytron can be added directly as a dispersion with mixing. Ethylene glycol distearate must be added in a molten state with rapid mixing to form the desired pearlescent crystals.

| Component | % By Weight | | | |
|---|---|---|---|---|
| | A | B | C | D |
| $C_{12-14}$ alkyl N-methyl glucamide[1] | 10.5 | 10.5 | 10.5 | 10.5 |
| Sodium $C_{13-14}$ alkyl ethoxy (1–3) sulfate | 17.00 | 17.00 | 17.00 | 17.00 |
| $C_{9-11}$ alkyl ethoxy (ave. 10) alcohol | 5.00 | 5.00 | 5.00 | 5.00 |
| $C_{12}$ alkyl fatty acid[1] | 1.4 | 1.4 | 1.4 | 1.4 |
| $C_{12-13}$ alkyl dimethyl amine oxide | 2.00 | 2.00 | 2.00 | 2.00 |
| Magnesium chloride hexahydrate | 0.1 | 0.1 | 0.1 | 0.1 |
| Calcium formate | 1.6 | 1.6 | 1.6 | 1.6 |
| Sodium cumene sulfonate | 2.00 | 2.00 | 2.00 | 2.00 |
| Sodium $C_{12-14}$ alkylpoly-ethoxy polycarboxylate | | | | |
| 65% hydrophilicity | — | 2.00 | 0 | 0 |
| 82% hydrophilicity | — | 0 | 2.00 | 0 |
| 88% hydrophilicity | — | 0 | 0 | 2.00 |
| Water and minors | | q.s. to 100% | | |

[1]The $C_{12-14}$ alkyl N-methyl glucamide contains about 88% of $C_{12-14}$ alkyl N-methyl glucamide and 12% $C_{12}$ alkyl fatty acid.

The following procedure shows how the above formulations are evaluated in terms of how well they maintain their stability. The method used to evaluate stability of the compositions of this invention involves storing a portion of the product without opacifier at 40° F. (4.4° C.), room temperature, and 120° F. (48.9° C.) for several days. At the end of the period the product is evaluated visually for stability and/or clarity.

TABLE I

| Composition | Stability Evaluation 7 Days | | |
|---|---|---|---|
| | 4.4° C. | Room Temperature | 48.9° C. |
| A | Unstable | Unstable | Unstable |
| B | Stable | Stable | Unstable* |
| C | Stable | Stable | Stable |
| D | Unstable | Stable | Unstable* |

*Recovers at room temperature.

Results: Composition C containing an alkylpolyethoxypolycarboxylate surfactant with 82% hydrophilicity remains the most stable over a range of temperatures. Composition A with no alkylpolyethoxypolycarboxylate surfactant is not stable at any of the storage temperatures. Compositions B and D containing alkylpolyethoxypolycarboxylate surfactant with lower and higher % hydrophilicity, respectively, than Composition C are in between the results for Compositions A and C.

Conclusion: The stability evaluation shows that the alkylpolyethoxypolycarboxylate-containing formulas, are more stable over a range of temperatures than compositions without alkyl polyethoxypolycarboxylate. Balancing the degree of carboxylation and ethoxylation (hydrophilicity), Composition C, is also effective in yielding a stable product.

Example II

The following liquid compositions are formulated. The compositions are prepared in the same manner as the compositions of Example I.

| Component | % By Weight | | |
|---|---|---|---|
| | E | F | G |
| $C_{12-14}$ alkyl N-methyl glucamide[1] | 11.6 | 11.6 | 11.6 |
| Sodium $C_{13-14}$ alkyl ethoxy (1–3) sulfate | 17 | 17 | 17 |
| $C_{9-11}$ alkyl ethoxy (10 ave.) alcohol | 5 | 5 | 5 |
| $C_{12}$ alkyl fatty acid[1] | 0.04 | 0.04 | 0.04 |
| $C_{12-13}$ alkyl dimethyl amine oxide | 3 | 3 | 3 |
| Calcium formate | 1.6 | 1.6 | 1.6 |
| Sodium $C_{12-14}$ alkylpolyethoxy poly-carboxylate, 82% hydrophilicity | — | 0.5 | — |
| Citric acid | — | — | 0.5 |
| Water and minors | | q.s. to 100% | |

[1]The $C_{12-14}$ alkyl N-methyl glucamide contains about 96.6% of $C_{12-14}$ alkyl N-methyl glucamide and about 3.3% $C_{12}$ alkyl fatty acid.

Product stability is evaluated as in Example I, results follow in Table II.

TABLE II

| Composition | Stability Evaluation 7 Days | | |
|---|---|---|---|
| | 4.4° C. | Room Temperature | 48.9° C. |
| E | Unstable | Unstable | Stable |
| F | Stable | Stable | Stable |
| G | Stable | Unstable | Unstable |

Results: Composition F containing alkypolyethoxypolycarboyxlate remains stable over a range of temperatures. Composition G containing citric acid (a chelator) does not remain stable at the higher temperature (i.e. 120° F., 48.9° C.) whereas Composition E containing no alkypolyethoxypolycarboxylate surfactant or citric acid is not stable at 40° F. (4.4° C.) or room temperature.

Conclusion: The stability evaluation shows that alkypolyethoxypolycarboxylate containing formulas are more stable over a range of temperatures than a composition containing citric acid, Composition F, or a composition containing no alkylpolyethoxypolycarboxylate or citric acid, Composition E.

Example III

The following compositions are formulated as in Example I.

| Component | % By Weight | |
|---|---|---|
| | H | I |
| $C_{12}$ alkyl N-methyl glucamide | 8.7 | 8.7 |
| Sodium $C_{13-14}$ alkyl ethoxy (1–3) sulfate | 15.0 | 20.0 |

-continued

| Component | % By Weight H | % By Weight I |
|---|---|---|
| $C_{9-11}$ alkyl ethoxy (10 ave.) alcohol | 4.0 | 2.0 |
| $C_{12}$ alkyl fatty acid[1] | 0.3 | 0.3 |
| $C_{13-14}$ alkyl dimethyl amine oxide | 3.0 | 2.0 |
| Calcium formate | 1.6 | 2.1 |
| Sodium $C_{12-14}$ alkylpolyethoxy polycarboxylate, 82% hydrophilicity | 1.5 | 0.5 |
| Water and minors | q.s. to 100% | q.s. to 100 |

[1]The $C_{12-14}$ alkyl N-methyl glucamide contains about 96.7% of $C_{12}$ alkyl N-methyl glucamide and about 3.3% of $C_{12}$ alkyl fatty acid.

The compositions remain stable for at least 14 days at 40° F. (4.4° C.), room temperature and 120° F.

Example IV

The following clear, stable, concentrated liquid composition are formulated. The compositions are prepared in the same manner as the compositions of Example I.

| Component | % By Weight J | % By Weight K |
|---|---|---|
| $C_{12}$ alkyl N-methyl glucamide | 11.1 | 9.0 |
| Sodium $C_{13-14}$ alkyl ethoxy (ave. 0.8) sulfate | 19.1 | 9.0 |
| Sodium $C_{13-14}$ alkyl ethoxy (ave. 3) sulfate | 3.1 | 8.0 |
| $C_{11}$ alkyl ethoxy (ave. 10) alcohol | — | 5.0 |
| $C_{10}$ alkyl ethoxy (ave. 8) alcohol | 4.6 | — |
| Dodecyl dimethyl betaine | 2.6 | 3.0 |
| $C_{13-14}$ alkyl dimethyl amine oxide | 1.6 | 2.0 |
| Calcium formate | 0.15 | 0.6 |
| Magnesium chloride hexahydrate | 0.75 | 0.3 |
| Sodium $C_{12-14}$ alkylpolyethoxypolycarboxylate, 82% hydrophilicity | 1.0 | 0.5 |
| Water and minors | q.s. to 100% | q.s. to 100 |

What is claimed is:

1. An aqueous liquid or gel dishwashing detergent composition comprising, by weight:

(a) from about 8% to about 40% of polyhydroxy fatty acid amide having the formula:

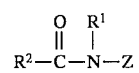

wherein $R^1$ is hydrogen, $C_{1-4}$ hydrocarbyl, 2-hydroxyethyl, 2-hydroxypropyl, and mixtures thereof; $R^2$ is —$C_5$–$C_{31}$ hydrocarbyl; and Z is a polyhydroxy-hydrocarbyl having a linear hydrocarbyl chain with at least three hydroxyl groups directly connected to the chain, or an alkoxylated derivative there, of;

(b) from about 0.3% to about 4% calcium ions;

(c) from about 0.1% to about 15% alkylpolyethoxypolycarboxylate surfactant having from about 60% to about 90% hydrophilicity and the general formula:

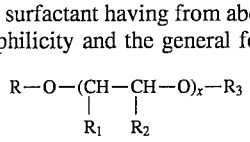

wherein R is a $C_6$ to $C_{18}$ alkyl group, x is from 1 to about 25, $R_1$ and $R_2$ arc selected from the group consisting of hydrogen, methyl radical, succinic acid radical, hydroxy succinic acid radical, and mixtures thereof, wherein at least one $R_1$ or $R_2$ is a succinic acid radical or a hydroxy succinic acid radical, and $R_3$ is selected from the group consisting of hydrogen, substituted or unsubstituted hydrocarbon having between 1 and 8 carbon atoms and mixtures thereof; and (d) from about 5% to about 40% of anionic surfactant; where, in said composition has a pH in a 10% solution in water of between 7 and 11.

2. A composition according to claim 1 comprising from about 5% to about 60% of said anionic surfactant which is selected from the group consisting of $C_{10}$–$C_{16}$ alkyl sulfate which has been ethoxylated with from about 0.5 to about 20 moles of ethylene oxide per molecule, $C_9$–$C_{17}$ acyl-N-($C_1$–$C_4$ alkyl) glucamine sulfate, —N—($C_2$–$C_4$ hydroxyalkyl) glucamine sulfate, and mixtures thereof.

3. A composition according to claim 2 wherein x of said alkylpolyethoxypolycarboxylate surfactant is from about 2 to about 1.

4. A composition according to claim 3 comprising said alkylpolyethoxypolycarboxylate surfactant having from about 65% to about 85% hydrophilicity.

5. A composition according to claim 4 wherein said comprising anionic surfactant is selected from the group consisting of alkyl sulfate, alkyl ether sulfate, polyethercarboxylate, secondary olefin sulfonates sarcosinates, methyl ester sulphonates, alkylglycerol ether sulphonates, and mixtures thereof.

6. A composition according to claim 5 further comprising from about 1% to about 15% of nonionic surfactant selected from the group consisting of polyethylene, polypropylene and polybutylene oxide condensates of alkyl phenols; the alkyl ethoxylate condensation products of aliphatic alcohols with ethylene oxide; the condensation products of ethylene oxide with a hydrophobic base formed by the condensation of propylene oxide with propylene glycol; the condensation product of ethylene oxide with the product resulting from the reaction of propylene oxide and ethylenediamine; alkylpolysaccharides; fatty acid amides; and mixtures thereof.

7. A composition according to claim 4 where Z in said polyhydroxy fatty acid amide is derived from glucose or maltose or mixtures thereof.

8. A composition according to claim 7 comprising from about 5% to about 60% of said anionic surfactant which is selected from the group consisting of $C_{10}$–$C_{16}$ alkyl sulfate which has been ethoxylated with from about 0. 5 to about 20 moles of ethylene oxide per molecule, $C_9$–$C_{17}$ acyl-N-($C_1$–$C_4$ alkyl) glucamine sulfate, -N-($C_2$–$C_4$ hydroxyalkyl) glucamine sulfate, and mixtures thereof.

9. A composition according to claim 8 comprising from about 8% to about 30% of said polyhydroxy fatty acid amide, wherein $R^1$ is $C_1$–$C_4$ alkyl and $R^2$ is a straight-chain $C_7$–$C_{19}$ alkyl or alkenyl group or mixture thereof.

10. A composition according to claim 9 comprising $C_{10}$–$C_{16}$ alkyl sulfate which has been ethoxylated with from about 0.5 to about 2.5 moles of ethylene oxide per molecule.

11. A composition according to claim 10 comprising from about 10% to about 40% of $C_{12}$–$C_{14}$ alkylsulfate which has been ethoxylated with from about 3 to about 10 moles of ethylene oxide per molecule.

12. A composition according to claim 11 wherein Z is selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2$ $(CHOR^1)$ (CHOH)—$CH_2OH$, where n is an integer from 3 to 5, inclusive, and R1 is H or a cyclic or aliphatic monosaccharide, and alkoxylated derivatives thereof.

13. A composition according to claim 12 wherein said calcium ions are added to said composition as a salt selected from the group consisting of chloride, hydroxide, oxide, acetate, formate nitrate and mixtures thereof.

14. A composition according to claim 13 further comprising from about 1% to about 15% of nonionic surfactant selected from the group consisting of polyethylene, polypropylene and polybutylene oxide condensates of alkyl phenols; the alkyl ethoxylate condensation products of aliphatic alcohols with ethylene oxide; the condensation products of ethylene oxide with a hydrophobic base formed by the condensation of propylene oxide with propylene glycol; the condensation product of ethylene oxide with the product resulting from the reaction of propylene oxide and ethylenediamine; alkylpolysaccharides; fatty acid amides; and mixtures thereof.

15. A liquid detergent composition according to claim 14 comprising from about 94% to about 35% of a liquid carrier comprising a mixture of water and a $C_1$-$C_4$ monohydric alcohol.

16. A liquid detergent composition according to claim 15 having a pH in a 10% solution in water at 20° C. of between about 7.5 and about 8.5.

17. A liquid detergent composition according to claim 16 wherein said anionic surfactant is alkyl sulfate or alkyl ether sulfate.

18. A liquid detergent composition according to claim 17 comprising from about 0.3% to about 1.5% of calcium ions added to the composition as calcium formate.

19. A liquid detergent composition according to claim 18 further comprising from about 0.05% to about 1.5% by weight of magnesium ions.

20. A liquid detergent composition according to claim 18 comprising a calcium ion:magnesium ion of between about 1:4 and about 1:2, and wherein said calcium and magnesium ions are added to said composition as a salt selected from the group consisting of chloride, hydroxide, oxide, acetate, formate, nitrate, and mixtures thereof.

21. A liquid detergent composition according to claim 20 comprising from about 1% to about 5% of said alkylpolyethoxypolycarboxylate surfactant.

22. A liquid detergent composition according to claim 21 comprising from about 8% to about 25% of said polyhydroxy fatty acid amide having the formula:

$$R^2-\overset{\overset{\displaystyle O}{\|}}{C}-\overset{\overset{\displaystyle CH_3}{|}}{N}-CH_2-(CHOH_4)CH_2OH$$

wherein $R^2$ is a straight chain $C_{11}$–$C_{17}$ alkyl or alkenyl group.

* * * * *